US006161244A

United States Patent [19]

Jeannet et al.

[11] Patent Number: 6,161,244

[45] **Date of Patent: *Dec. 19, 2000**

[54] TOOTHBRUSH

[75] Inventors: Roland Jeannet, Dusseldorf, Germany; Robert Leutwyler, Boppelsen; Werner Leutwyler, Zurich, both of Switzerland

[73] Assignee: Johnson & Johnson Consumer Products, Inc., Skillman, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 09/479,631

[22] Filed: Jan. 7, 1999

Related U.S. Application Data

[63] Continuation of application No. 09/163,237, Sep. 30, 1998, abandoned, which is a continuation of application No. 09/053,942, Apr. 2, 1998, abandoned, which is a continuation of application No. 08/926,597, Aug. 21, 1997, abandoned, which is a continuation of application No. 08/617,974, Mar. 15, 1996, abandoned, which is a continuation of application No. 08/382,943, Jan. 31, 1995, abandoned, which is a continuation of application No. 08/195,978, Feb. 14, 1994, abandoned, which is a continuation of application No. 07/990,736, Dec. 15, 1992, abandoned.

[30] Foreign Application Priority Data

Dec. 19, 1991 [DE] Germany ..... 41 41 891

[51] Int. Cl.[7] ..... A46B 9/04

[52] U.S. Cl. ..... 15/167.1; 15/145; 15/176.1; 15/176.6; 403/327; 403/349

[58] Field of Search ..... 15/144.1, 145, 15/167.1, 172, 176.1–176.6; 403/326, 327, 348, 349

[56] References Cited

U.S. PATENT DOCUMENTS

| | | | |
|---|---|---|---|
| 607,105 | 7/1898 | Wilkinson | 403/349 X |
| 935,493 | 9/1909 | Gramm et al. | 15/167.1 X |
| 2,002,320 | 5/1935 | Jones | 15/172 |
| 2,091,716 | 8/1937 | Petta | 15/172 |
| 2,527,256 | 10/1950 | Jackson | 403/349 X |
| 3,081,783 | 3/1963 | Miller | 15/176.1 X |

FOREIGN PATENT DOCUMENTS

| | | | |
|---|---|---|---|
| 676374 | 2/1930 | France | 403/349 |
| 923294 | 2/1947 | France | 403/349 |
| 929815 | 1/1948 | France | 15/176.2 |

*Primary Examiner*—Mark Spisich
*Attorney, Agent, or Firm*—Reed, Smith, Shaw & McClay LLP

[57] ABSTRACT

The invention relates to a toothbrush (20) with a brush head which can be secured on a brush handle (24) by a bayonet catch (26). The bayonet catch comprises a locking pin (28) which is mounted in the front end of the brush handle (24) in such a way that it can be displaced axially to a limited extent but is non-rotatable and which is subject to the action of a prestressing device (50). The brush head (22) is provided with a recess (102) which has a locking groove pursuant to which the brush head (22) is mounted on the locking pin (28) by engagement of a bayonet stud (32) in the locking groove (106), the locking pin (28) being pulled out of the brush handle (24) counter to the prestressing device (50) until the bayonet stud (32) locks into a lock-in portion (114) of the locking groove. Since the locking groove is arranged in the bristle bed (100) of the brush head (22), a minimum use of material for the brush head, which is disposable after wearing out, is guaranteed and the brush head is reliably secured on the brush handle.

10 Claims, 5 Drawing Sheets

TOOTHBRUSH

Figure 1:
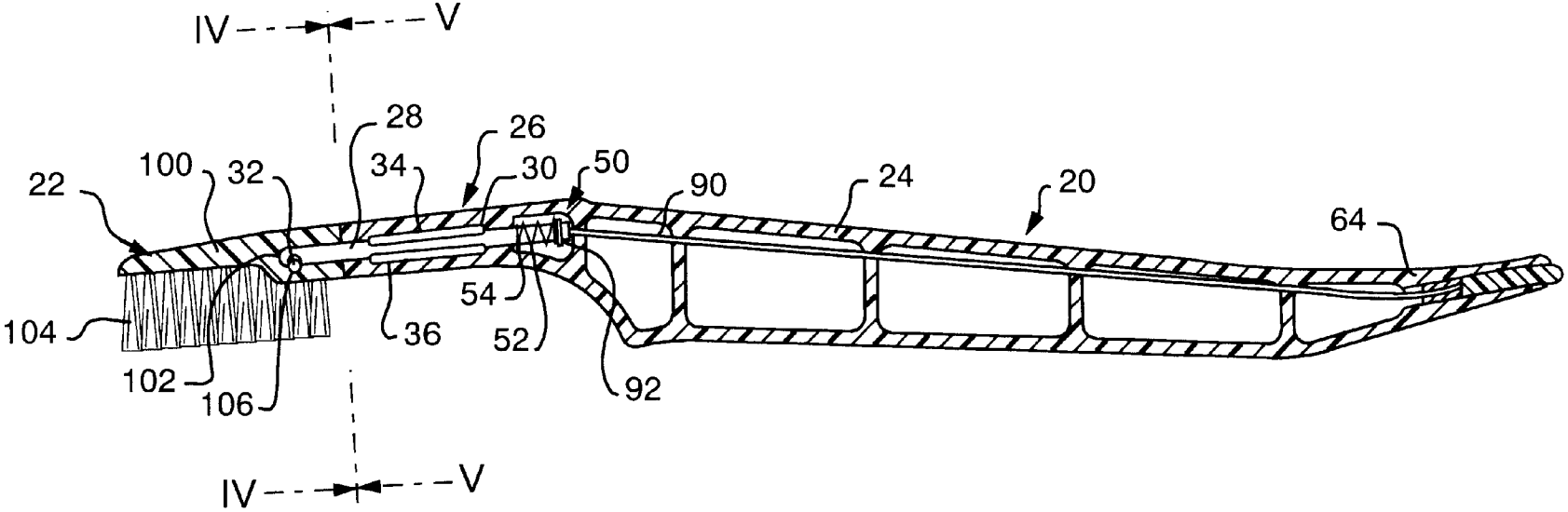

This is a continuation of Application Ser. No. 09/163,237, filed Sep. 30, 1998, now abandoned, which is a continuation of Application Ser. No. 09/053,942, filed Apr. 2, 1998, now abandoned, which is a continuation of Application Ser. No. 08/926,597, filed Aug. 21, 1997, now abandoned, which is a continuation of Application Ser. No. 08/617,974, filed Mar. 15, 1996, now abandoned, which is a continuation of Application Ser. No. 08/382,943, filed Jan. 31, 1995, now abandoned, which is a continuation of Application Ser. No. 08/195,978, filed Feb. 14, 1994, now abandoned, which is a continuation of Application Ser. No. 07/990,736, filed Dec. 15, 1992, now abandoned.

The invention relates to a toothbrush, the brush head of which is connected releasably to the brush handle by a plug-in and lock-in connection.

EP 0 326 363 A1 discloses a toothbrush in which the brush handle has a conical shape at its front end and in which the rear end of the brush head, the said end facing the brush handle, has a corresponding recess. The cone on the brush handle is provided with an annular bead which engages in an annular groove in the recess of the brush head and thus forms a snap-in holding device which fixes the brush head on the brush handle in the axial direction. Longitudinal ribs provided on the cone engage in corresponding longitudinal grooves in the recess of the brush head in order to provide a connection fixed in terms of rotation.

The object on which the invention is based is to improve a toothbrush of the known generic type stated in such a way that a firm, reliable connection between the brush head and the brush handle is provided in the longitudinal direction during its use, also providing a child-proof safety catch, but that the brush head can nevertheless be released again relatively easily from the brush handle and, if required, replaced by a new brush head. The material requirement for the disposable brush head should be minimal.

The invention achieves this object by the fact that the releasable connection between brush head and brush handle is designed as a bayonet catch.

The bayonet catch can advantageously be assigned an unlocking device having an actuating member which is displaceably mounted in the brush handle and is connected to the bayonet catch, which can thus be unlocked by actuating the unlocking device. The bayonet catch expediently comprises at least one locking groove in an axial recess in a rear end of the brush head, the said end facing the brush handle, and a locking pin in an axial sliding bearing of the front end of the brush handle, the said end facing the brush head. The locking pin is here mounted in the sliding bearing in such a way that it is movable backwards and forwards to a limited extent but is non-rotatable, and is resiliently prestressed in the direction away from the brush head. At its end protruding freely out of the brush handle, the locking pin is furthermore provided with at least one bayonet stud directed radially to the locking pin and intended for engagement in the locking groove of the brush head.

It is particularly advantageous if the locking groove is arranged in the rear end of the bristle bed of the brush head and the sliding bearing is arranged in the front end of the neck on the brush handle. Extremely economical use of material for the production of the replaceable brush head is thereby achieved.

The limitation of the axial movement of the locking pin is advantageously achieved by means of radial projections of the locking pin which engage in exclusively longitudinally displaceable fashion in longitudinal guides in the wall of the sliding bearing in the brush handle. It is furthermore advisable to design the sliding bearing and the locking groove as integral components of the brush handle and of the brush head respectively. The sliding bearing can be designed such that it is delimited for the locking pin, at its inner end facing away from the brush head, by a transverse wall against which the inner end of the pin shank rests, that end of the pin shank which extends through an axial bore of the transverse wall being connected to a part of a prestressing device, the other part of which is secured in the brush handle. The prestressing device may, like the locking pin, be produced from plastic, with the result that the entire toothbrush is composed exclusively of plastic.

The locking groove in the brush head for receiving the locking pin with the bayonet stud expediently consists of a curve portion parallel to the axis, a curve portion extending in the axial direction and over a circumferential angle of the longitudinal bore, and of a locking portion angled towards the rear end of the brush head.

Figure 2:
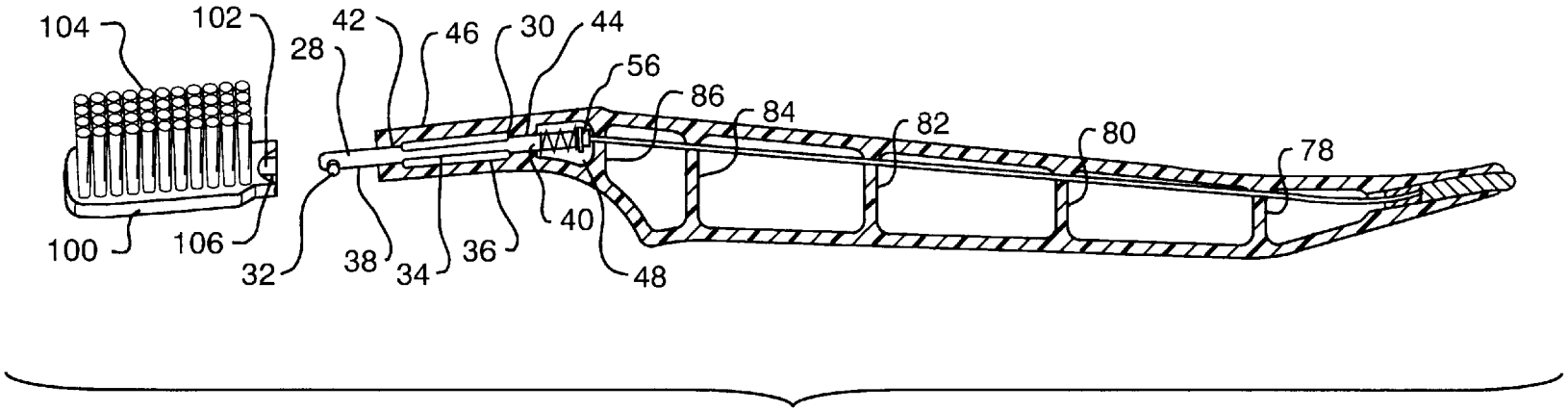
Figure 3:
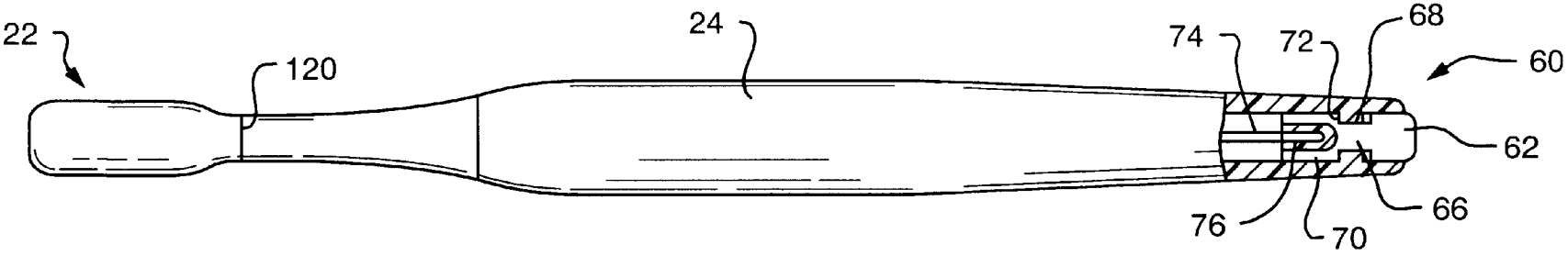
Figure 4:
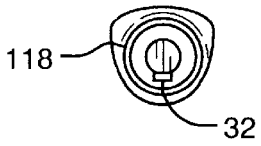
Figure 5:
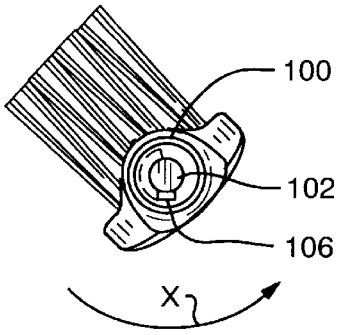
Figure 6:
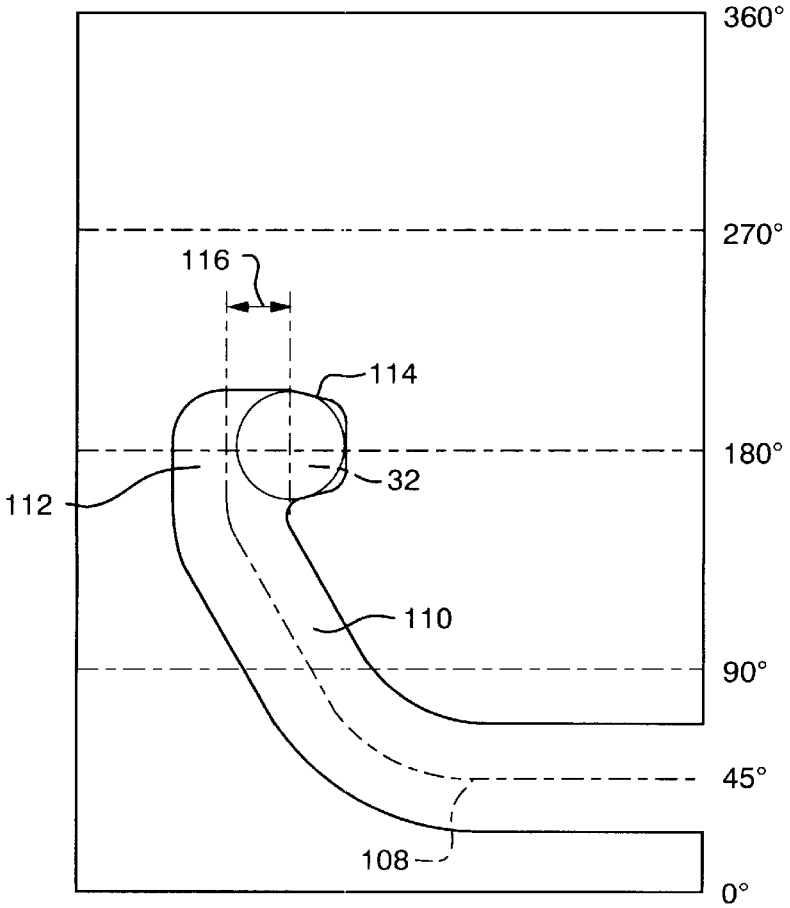
Figure 7:
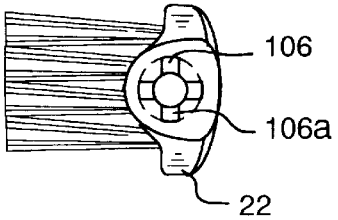
Figure 8:
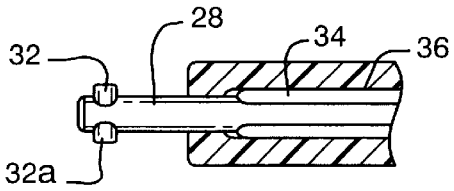
Figure 9:
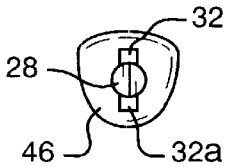
Figure 10:
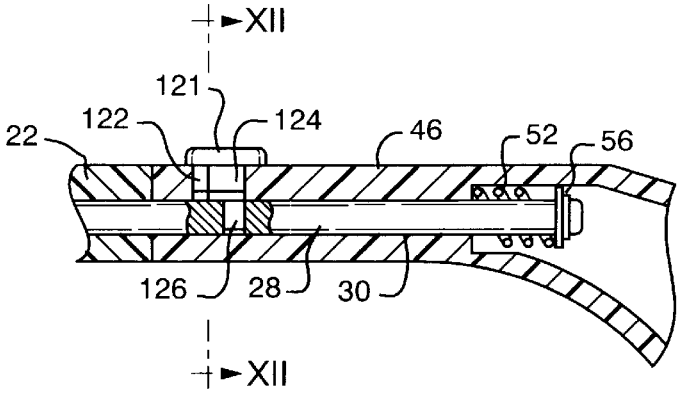
Figure 11:
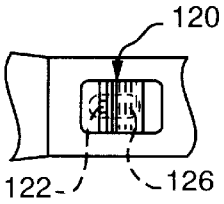
Figure 12:
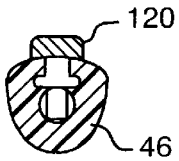

The invention is explained in greater detail in the drawing by means of the schematic drawing of illustrative embodiments of the toothbrush according to the invention. In the drawing:

FIG. 1 shows a vertical section through the longitudinal centre line of a toothbrush with mounted brush head, FIG. 2 shows the toothbrush in a view similar to that in FIG. 1 but with the brush head in the unlocked position, FIG. 3 shows a partially sectioned plan view of the rear side of the brush, the said rear side facing away from the bristles, FIG. 4 shows a view in accordance with IV—IV in FIG. 1 of the front end of the handle neck, the said end facing the brush handle, FIG. 5 shows a view in accordance with V—V in FIG. 1, FIG. 6 shows a curve development of the locking groove of the bayonet catch, FIGS. 7, 8 and 9 show the rear end of a brush head, the side view of a locking pin and an end view of the locking pin in FIG. 8, FIG. 10 shows another embodiment of an unlocking device in a vertical section along the longitudinal centre line, FIG. 11 shows a plan view relating to FIG. 10, and FIG. 12 shows a section along the line XII—XII in FIG. 10.

FIGS. 1 to 3 show a toothbrush 20, the brush head 22 of which is locked to a brush handle 24 by a bayonet catch 26. The bayonet catch comprises a locking pin 28 which is mounted in a sliding bearing 30 in the forward handle neck 46 of the brush handle 24 in such a way that it is displaceable axially to a limited extent but is non-rotatable and which protrudes with its front end out of the front end of the handle neck, the said end facing the brush head 22. The free outer end of the locking pin 28 is provided with a radially projecting bayonet stud 32. The locking pin 28 is provided approximately halfway along its length with one or more longitudinal ribs 34, which engage in longitudinal grooves 36 in the sliding-bearing wall of the handle neck. The longitudinal grooves 36 are longer than the longitudinal ribs 34 of the locking pin 28 by the stroke length of the locking pin 28 and in this way ensure the limited axial displaceability of the locking pin 28. The front end 38 and the rear end 40 of the locking pin serve as cylindrical guide shanks which are guided in corresponding coaxial bores 42 and 44, respectively, of the sliding bearing in the handle neck 46. The rear shank end 40 of the locking pin 28, the said end protruding into a cavity 48 of the brush handle 24, carries a prestressing device 50 which, in the illustrative embodiment under consideration, is designed as a helical compression spring 52. The ends of the helical compression spring are supported, on the one hand, on a transverse wall 54 in the brush handle 24, the said transverse wall containing the bore 44, and on a supporting disc 56 which is secured on the inner end of the threaded pin 28.

FIGS. 1 to 3 furthermore show an unlocking device 60 comprising a pressure plate 62 which is mounted in longitudinally displaceable fashion in the rear end 64 of the brush handle 24. In plan view, the pressure plate is of H-shaped configuration, as FIG. 3 shows, a central web 66 of the pressure plate being mounted in an axial slot 68 in the brush handle 24 in such a way that it can be displaced backwards and forwards to a limited extent. In this arrangement, the inner plate part 70 of the pressure plate 62 normally rests against stop faces 72 in the brush handle 24. This position is secured by a wire 74 being fixed or loosely inserted in the plate part 70 at 76 and extending with longitudinal mobility through transverse walls at 78, 80, 82, 84, 86 in FIG. 2 and engaging with its end facing away from the pressure plate in a spherical cup 92 in the rear end of the locking pin 28 and resting against the latter. Since the wire is of sufficiently rigid design, the pressure plate 62 is at all times held in the position shown in FIG. 3 by the locking pin 28 subject to the action of the prestressing device 50. If the pressure plate 62 is pressed into the brush handle 24, the locking pin 28 can be moved axially out of the handle neck 46, counter to the action of the prestressing device 50, by a stroke length which permits unlocking, this stroke length being determined by the length of the longitudinal grooves 36 in the handle neck 46 for the longitudinal ribs 34 on the locking pin 28.

The brush head 22 has a bristle bed 100 which, as shown in particular by FIGS. 1 and 5, is distinguished in the region of an axial recess 102 by a central, longitudinally extending bulge. In this way, the parting plane between the abutting end faces of the brush head 22 and the handle neck 46 is brought extremely close to the bristles 104 of the brush element, a considerable saving in material thereby being achieved for the brush head 22, which can be discarded after a certain time in use and replaced by a new brush head. Arranged in the cylindrical wall of the recess 102 in the brush head 22 is at least one locking groove 106, the development of which can be seen from FIG. 6. According to this figure, the locking groove consists of an axial portion 108, adjoining which is a helically curved portion 110, which merges into a portion 112 extending transversely to the axial direction of the recess 102 and merging at the outer end into a lock-in portion 114 which is angled by 90° relative to portion 112 towards the rear end facing the brush handle 24 and accommodates the bayonet stud 32 in the lock-in position. 116 denotes the lock-in path which the bayonet stud with the locking pin 28 must travel into the interior of the brush handle 24, under the action of the prestressing device 50, in order to be able to reach the lock-in position or be moved back out of the lock-in position into the locking groove when the brush head 22 is to be removed from the brush handle 24.

The locking groove is produced from injection-moulded plastic as an integral component of the bristle bed, as can be seen from the view in FIG. 4. 118 denotes annular sealing ribs in FIG. 4, the said ribs guaranteeing reliable sealing of the parting plane between the brush head 22 and the brush handle 24.

As FIG. 5 shows, the closing angle or angle of rotation of the brush head from the mounting position to the closing position of the bayonet catch is 135°, the closing direction being indicated by the arrow X.

Two diametrically opposite locking grooves 106, 106*a* can be seen in the brush element 22 in FIG. 7. In this case, the closing angle is only 90°. FIG. 8 shows corresponding bayonet studs 32 and 32*a*, these being shown in an end view in FIG. 9.

Another embodiment of an unlocking device 120 is depicted in FIGS. 10 to 12. This unlocking device 120 comprises an unlocking button 121, which is guided by means of a connecting pin 124 in an elongated slot 122 on the rear side of the handle neck 46, the said pin being secured on the underside of the unlocking button 120 and being firmly connected to the locking pin 28 by means of a locking peg 126. Although, in this embodiment, the locking pin 28 can likewise be provided with the longitudinal ribs 34 which engage in the longitudinal grooves 36 of the brush neck 46 in accordance with FIGS. 1 and 2, the unlocking button 121 with its connecting pin 124 and locking peg 126 may be quite sufficient as a stop for the limitation of the axial backwards and forwards mobility of the locking pin 28, as FIG. 10 shows by means of the brush head 22, depicted in essentially broken-away form. Appropriate selection of the characteristic of the helical compression spring 52 allows the bayonet catch for the illustrative embodiments in FIGS. 1, 2 and 10 to be configured in such a way that it can be used as a child-proof catch. It is self-evident that it is also possible, instead of the helical compression spring, to use tension springs, one end of which is anchored on the rear end of the locking pin and the other end of which is anchored in the brush handle 24. The springs used can, if required, like the locking pin and the unlocking devices in FIGS. 1, 2 and 10, be composed completely of plastic since, if required, the wire 90 in FIG. 1 can also be composed of a relatively flexurally stiff plastics material.

LIST OF REFERENCE NUMERALS

20 Toothbrush
22 Brush head
24 Brush handle
26 Bayonet catch
28 Locking pin
30 Sliding bearing
32 Sayonet stud
32*a* Bayonet stud
34 Longitudinal ribs
36 Longitudinal grooves
38 Front end
40 Rear end
42 Bore
44 Bore
46 Handle neck
48 Cavity
50 Prestressing device
52 Helical compression spring
54 Transverse wall
56 Supporting disc
60 Unlocking device
62 Pressure plate
64 Rear end
66 Central web
68 Slot
70 Plate part
72 Stop face
74 Wire
78 Transverse wall
80 Transverse wall
82 Transverse wall
84 Transverse wall

86 Transverse wall
90 Wire
92 Spherical cup
100 Bristle bed
102 Recess
106 Locking groove
106*a* Locking groove
104 Bristles
108 Portion
110 Portion
112 Portion
114 Portion
116 Lock-in path
118 Sealing ribs
120 Unlocking device
122 Elongated slot
124 Connecting pin
126 Locking peg

What is claimed is:

1. A toothbrush comprising a brush head and a brush handle;

wherein said brush head comprises a front end and a rear end;

wherein said brush head includes an axial recess extending along a longitudinal axis of said rear end of said brush head;

wherein said brush handle comprises a front end and a rear end; and wherein said brush handle further comprises an axial sliding bearing extending along a longitudinal axis of said front end of said brush handle;

wherein said brush head is releasably connected to said brush handle by a bayonet catch;

wherein said bayonet catch comprises at least one locking groove in said axial recess in said rear end of said brush head; and a locking pin which is mounted in said axial sliding bearing:

wherein said locking pin comprises a front end which protrudes out of said front end of said brush handle wherein said front end of said locking pin comprises at least one bayonet stud, each said bayonet stud being directed radially to the locking pin and engaging a corresponding said locking groove; and wherein said locking pin is movable within said axial sliding bearing to a limited extent along said longitudinal axis of said front end of said brush handle and is non-rotatable about said longitudinal axis of said front end of said brush handle; and wherein said locking pin is resiliently prestressed by a prestressing device along said longitudinal axis of said front end of said brush handle in a direction away from the brush head.

2. The toothbrush according to claim 1 wherein the axial sliding bearing is an integral component of the brush handle (24) and the locking groove is an integral component of the brush head.

3. The toothbrush according to claim 1 wherein the locking groove comprises a first curve portion parallel to the axis, a second curve portion extending in the axial direction and over a circumferential angle of the axial recess and a locking portion for engaging the bayonet stud of the locking pin, the said locking portion being angled towards the rear end of the brush head.

4. The toothbrush according to claim 1 wherein the brush handle further comprises a handle neck.

5. The toothbrush according to claim 4 wherein the brush head further comprises a bristle bed comprising a front end and rear end and wherein the locking groove is arranged in the rear end of the bristle bed of the brush head and the axial sliding bearing is arranged in the front end of the handle neck.

6. The toothbrush according to claim 1 wherein the walls of said axial sliding bearing include at least one longitudinal locking groove.

7. The toothbrush according the claim 6, wherein the locking pin further comprises at least one longitudinal rib which projects radially from the locking pin, which includes a rear end, and which engages longitudinally the at least one longitudinal locking groove.

8. The toothbrush according to claim 7 wherein the axial sliding bearing comprises a first end and a second end; and wherein said second end of the axial sliding bearing is bounded by a stop of the longitudinal locking groove, against which stop the rear end of the at least one longitudinal rib rests; and wherein the locking pin includes an end shank, which end shank extends out of the second end of the axial sliding bearing into the interior of the brush handle; and wherein the prestressing device comprising a first end and a second end is connected at its first end to the end shank and is connected at its second end within the brush handle.

9. The toothbrush according to claim 1 wherein the toothbrush further comprises an unlocking device wherein said unlocking device comprises an actuating member which is displaceably mounted on said brush handle and is connected to said bayonet catch and which is capable of unlocking said bayonet catch when actuated.

10. The toothbrush according to claim 9 wherein said locking groove includes a locking portion and wherein said actuating member is connected to the locking pin and allows the locking pin to be moved out of the locking portion in the brush head counter to the action of the prestressing device.

* * * * *